US009122215B2

(12) United States Patent
Matsushita

(10) Patent No.: US 9,122,215 B2
(45) Date of Patent: Sep. 1, 2015

(54) IMAGE FORMING APPARATUS

(71) Applicant: Brother Kogyo Kabushiki Kaisha, Nagoya-shi, Aichi-ken (JP)

(72) Inventor: Yuichi Matsushita, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/334,695

(22) Filed: Jul. 18, 2014

(65) Prior Publication Data

US 2015/0023675 A1 Jan. 22, 2015

(30) Foreign Application Priority Data

Jul. 19, 2013 (JP) ..... 2013-150025

(51) Int. Cl.
*G03G 15/00* (2006.01)

(52) U.S. Cl.
CPC ..... *G03G 15/50* (2013.01)

(58) Field of Classification Search
CPC ..... G03G 15/50; G03G 15/5008
USPC ..... 399/38
See application file for complete search history.

(56) References Cited

U.S. PATENT DOCUMENTS

| | | | | |
|---|---|---|---|---|
| 7,187,879 | B2 | 3/2007 | Zaima | |
| 2002/0113734 | A1* | 8/2002 | King | 342/357.13 |
| 2005/0190386 | A1* | 9/2005 | Zaima | 358/1.9 |

FOREIGN PATENT DOCUMENTS

JP 2005-189356 A 7/2005

* cited by examiner

*Primary Examiner* — Walter L Lindsay, Jr.
*Assistant Examiner* — Frederick Wenderoth
(74) *Attorney, Agent, or Firm* — Banner & Witcoff, Ltd.

(57) ABSTRACT

In an image forming apparatus, a controller includes a memory stores control parameters for use in adjustment to be made in at least one of a print density and a color alignment in accordance with a surrounding condition, a print-mode execution module executes a print-mode process of causing the image forming unit to perform image formation, and an adjustive test-mode execution module executes an adjustive test-mode process of causing the image forming unit to perform a test print, thereby determining a control parameter. The print-mode execution module retrieves a relevant control parameter corresponding to a current surrounding condition from the memory, if available, while it causes the adjustive test-mode execution module to execute the adjustive test-mode process, thereby determining a relevant control parameter if the relevant control parameter is not stored in the memory. The retrieved or determined relevant control parameter is applied to the image formation.

13 Claims, 9 Drawing Sheets

| | | TEMPERATURE | | | |
|---|---|---|---|---|---|
| | | < 10°C | 10 - 20°C | 20 - 30°C | 30°C < |
| HUMIDITY | 80 - 100% | | | | |
| | 60 - 80% | | | $V_2$, $N_2$ | |
| | 40 - 60% | | | $V_1$, $N_1$ (=0) | |
| | 20 - 40% | | | $V_3$, $N_3$ | |
| | 0 - 20% | | | | |

| | | TEMPERATURE | | | |
|---|---|---|---|---|---|
| | | < 10°C | 10 – 20°C | 20 – 30°C | 30°C < |
| HUMIDITY | 80 – 100% | | | | |
| | 60 – 80% | | | $V_{12}$, $N_{12}$ | |
| | 40 – 60% | | | $V_{11}$, $N_{11}$ | |
| | 20 – 40% | | | $V_{13}$, $N_{13}$ | |
| | 0 – 20% | | | | |

| | | TEMPERATURE | | | |
|---|---|---|---|---|---|
| | | < 10°C | 10 – 20°C | 20 – 30°C | 30°C < |
| HUMIDITY | 80 – 100% | | | | |
| | 60 – 80% | | | $P_3$, $N_{23}$ | |
| | 40 – 60% | | | $P_1$, $N_{21}$ | |
| | 20 – 40% | | | $P_2$, $N_{22}$ | |
| | 0 – 20% | | | | |

| | | TEMPERATURE | | | |
|---|---|---|---|---|---|
| | | < 10°C | 10 - 20°C | 20 - 30°C | 30°C < |
| HUMIDITY | 80 - 100% | | | | |
| | 60 - 80% | | | Y 0<br>M 0<br>C -1 | |
| | 40 - 60% | | | Y 0<br>M 0<br>C -1 | |
| | 20 - 40% | | | Y 0<br>M +1<br>C 0 | |
| | 0 - 20% | | | | |

IMAGE FORMING APPARATUS

CROSS-REFERENCE TO RELATED APPLICATION(S)

This application claims priority from Japanese Patent Application No. 2013-150025 filed on Jul. 19, 2013, the disclosure of which is incorporated herein by reference in its entirety.

BACKGROUND

1. Field

The present invention relates to an electrophotographic image forming apparatus.

2. Description of Related Art

In the electrophotographic image forming apparatus, the print density varies according to the surrounding conditions such as temperature, humidity and the like. In the image forming apparatus which performs color printing, in particular, the pixel position of each color shifts according to the temperature. Therefore, in these types of image forming apparatus, typically, the test print is performed every time when the surrounding conditions change, and a control parameter for use in adjustment to be made in the print density or color alignment (registration) is determined based upon the result of the test print, and printing (image forming) is performed using this control parameter.

SUMMARY

The test print performed every time when the surrounding conditions change would disadvantageously require a long time to elapse before starting the printing.

It is one aspect of the present invention to provide an image forming apparatus with quick print start capability which may be achieved by decreasing the frequency of test prints (test-mode processes).

According to one or more embodiments, an image forming apparatus is provided which comprises an image forming unit and a controller. The image forming unit includes a photoconductor drum, a charger configured to charge the photoconductor drum, an exposure device configured to expose the photoconductor to light, and a developing roller configured to supply developer to the photoconductor drum. The controller is configured to control an operation of the image forming unit, and comprises a memory, a print-mode execution module, and an adjustive test-mode execution module. The memory is configured to store control parameters for use in adjustment to be made in at least one of a print density and a color alignment in accordance with a surrounding condition. The print-mode execution module is configured to execute a print-mode process of causing the image forming unit to perform image formation. The adjustive test-mode execution module is configured to execute an adjustive test-mode process of causing the image forming unit to perform a test print, thereby determining a control parameter, and causing the memory to store the determined control parameter associated with a specific surrounding condition under which said test print was performed. In this image forming apparatus, the print-mode execution module is configured: (1) to retrieve a relevant control parameter corresponding to a current surrounding condition from the memory if the relevant control parameter is stored in the memory when the print-mode execution module executes a print-mode process; and (2) to cause the adjustive test-mode execution module to execute the adjustive test-mode process, thereby determining a relevant control parameter if the relevant control parameter is not stored in the memory when the print-mode execution module executes the print-mode process, whereby the retrieved or determined relevant control parameter is applied to the image formation to be performed by the image forming unit.

BRIEF DESCRIPTION OF THE DRAWINGS

The above aspect, its advantages and further features of the present invention will become more apparent by describing in detail illustrative, non-limiting embodiments thereof with reference to the accompanying drawings, in which.

DESCRIPTION OF EMBODIMENTS

Figure 1:
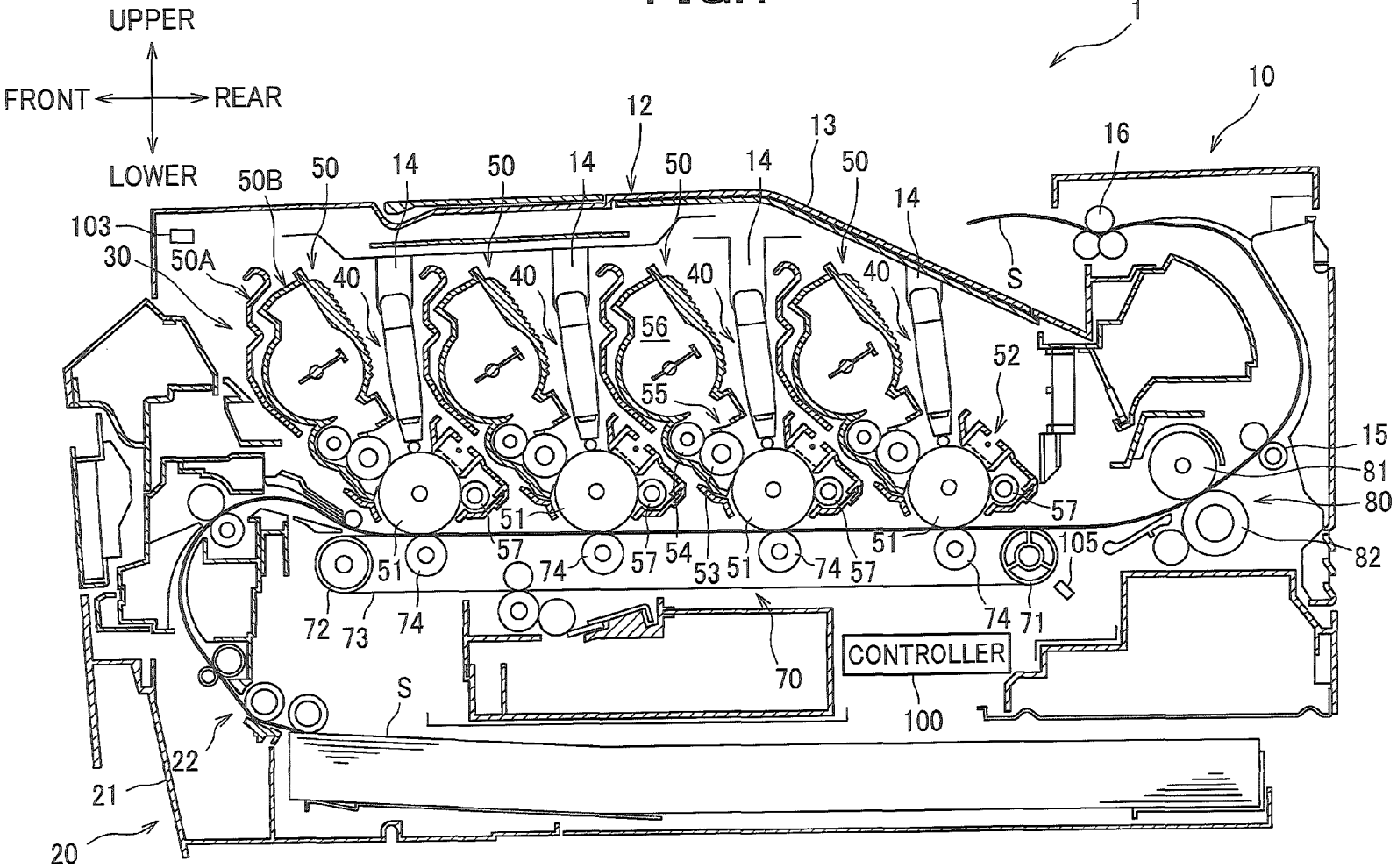
FIG. 1 is a schematic diagram showing a general setup of a color printer as one example of an image forming apparatus according to an illustrative, non-limiting embodiment.

A detailed description will be given of an illustrative, non-limiting embodiment of the present invention with reference made to the drawings where appropriate. In the following description, the direction is designated as from the viewpoint of a user who is using (operating) the color printer 1. To be more specific, in FIG. 1, the left-hand side of the drawing sheet corresponds to the "front" side of the printer, the right-hand side of the drawing sheet corresponds to the "rear" side of the printer, the front side of the drawing sheet corresponds to the "right" side of the printer, and the back side of the drawing sheet corresponds to the "left" side of the printer. Similarly, the direction of a line extending from top to bottom of the drawing sheet corresponds to the "vertical" or "up/down (upper/lower or top/bottom)" direction of the printer.

<General Setup of Color Printer>

As shown in FIG. 1, the color printer 1 comprises a main body housing 10, and several components housed within the main body housing 10, which principally include a sheet feeder unit 20 and an image forming unit 30. An upper part of the main body housing 10 is provided with an upper cover 12 configured to be swingable upward and downward about an axis provided at a rear portion thereof.

The sheet feeder unit 20 is provided in a bottom space within the main body housing 10, and mainly includes a sheet feed tray 21 configured to store sheets S (an example of medium to which a developer image is to be transferred) therein, and a sheet feed mechanism 22 configured to feed a sheet S from the sheet feed tray 21 to the image forming unit 30. Sheets S in the sheet feed tray 21 are separated (uppermost one separated from others) and forwarded one by one to the image forming unit 30 by the sheet feed mechanism 22.

The image forming unit 30 mainly includes four LED units 40 as an example of an exposure device, four process units 50, a transfer unit 70, and a fixing unit 80.

Each of the LED units 40 is disposed over a corresponding photoconductor drum 51, and opposed to an upper side of the photoconductor drum 51. Each LED unit 40 includes an array of light-emitting diodes or LEDs (not shown) arranged in a lateral direction at a lower end thereof. The LEDs of the LED unit 40 are configured to selectively emit light in accordance with image data, so that the peripheral surface of the photoconductor drum 51 is exposed to light. Each LED unit 40 is held by a corresponding holder part 14 of the upper cover 12 and thus supported on the upper cover 12. Accordingly, when the upper cover 12 is swung open, the LED units 40 are moved away from the photoconductor drums 51.

The process units 50 are disposed between the upper cover 12 and the sheet feed tray 21, and arranged in tandem in a front-rear direction. Each process unit 50 is configured to be detachable and installable (replaceable) from and in the main body housing 10 through an opening of the main body housing 10 which becomes available (making the inside of the main body housing 10 accessible) when the upper cover 12 is in an open position. Each process unit 50 mainly includes a photoconductor drum 51, a charger 52 configured to charge the photoconductor drum 51, a developing roller 53 configured to supply toner (developer) to the photoconductor drum 51, a supply roller 54, a doctor blade 55, a toner reservoir 56 configured to store positively chargeable toner (developer), and a cleaning roller 57.

The process unit 50, as known in the art, includes a photoconductor cartridge 50A configured to support the corresponding photoconductor drum 51 and a development cartridge 50B configured to support the corresponding developing roller 53 and to store toner. The development cartridge 50B is detachably attached to the photoconductor cartridge 50A. In an appropriate position of the main body housing 10, a known cartridge sensor 107 (see FIG. 2) configured to determine whether the photoconductor cartridge 50A and/or the development cartridge 50B have been changed is provided. The cartridge sensor 107 may be provided on the photoconductor cartridge 50A and on the development cartridge 50B. The cartridge sensor 107 may be configured as a sensor that senses the motion of a part of the cartridge 50A or 50B which irreversibly moves when the cartridge 50A or 50B is installed or used for the first time, or a sensor that reads information on an IC chip embedded in the cartridge 50A or 50B.

The transfer unit 70 is disposed between the sheet feeder unit 20 and the process units 50, and mainly includes a driving roller 71, a driven roller 72, a conveyor belt 73 as an endless belt, and four transfer rollers 74. The conveyor belt 73 is looped around the driving roller 71 and the driven roller 72, with its outer surface disposed opposite to the photoconductor drums 51. The transfer rollers 74 are disposed inside (on an inner surface of) the conveyor belt 73 in positions corresponding to the respective photoconductor drums 51, such that the conveyor belt 73 is held between each transfer roller 74 and the corresponding photoconductor drum 51. At the lower rear side of the driving roller 71, an image sensor 105 is disposed opposite to the outer surface of the conveyor belt 73. The image sensor 105 includes an LED, a phototransistor, and other parts. The image sensor 105 is configured as a sensor which reads a predetermined test pattern of toner placed on the conveyor belt 73.

The fixing unit 80 is disposed rearwardly of the process units 50 and the transfer unit 70, and mainly includes a heating roller 81, and a pressure roller 82 disposed opposite to the heating roller 81 and pressed against the heating roller 81.

In the image forming unit 30 configured as described above, the peripheral surface of each photoconductor drum 51 is uniformly charged by the corresponding charger 52, and then illuminated with LED light emitted from the corresponding LED unit 40. This lowers the potential of illuminated portions so that an electrostatic latent image formulated based upon the image data is formed on the peripheral surface of each photoconductor drum 51.

Toner in each toner reservoir 56 is supplied by the rotation of the supply roller 54 to the developing roller 53, and (as the developing roller 53 rotates) forwarded to pass through an interface between the developing roller 53 and the doctor blade 55 so that a thin layer of toner having a predetermined thickness is carried on the developing roller 53.

Toner carried on the peripheral surface of the developing roller 53 is supplied to the electrostatic latent image formed on the photoconductor drum 51 when the peripheral surface of the rotating developing roller 53 becomes opposed to and brought into contact with the photoconductor drum 51. Accordingly, the toner is carried selectively on regions of the peripheral surface of the photoconductor drum 51, so that the electrostatic latent image is visualized to form a toner image by a reversal process.

Thereafter, while a sheet S fed onto the conveyor roller 73 is conveyed through an interface between the photoconductor drum 51 and the conveyor belt 73 (behind which the transfer roller 74 is disposed), the toner image (developer image) formed on the peripheral surface of the photoconductor drum 51 is transferred onto the sheet S.

When the sheet S with the transferred toner image carried thereon is conveyed through an interface between the heating roller 81 and the pressure roller 82, the toner image is thermally fixed on the sheet S.

A conveyor roller 15 is provided rearwardly of the fixing unit 80, and an output roller 16 is provided above the fixing unit 80. The sheet S outputted from the fixing unit 80 is ejected by the conveyor roller 15 and the output roller 16 to the outside of the main body housing 10, and placed and accumulated on the sheet output tray 13.

<Print Density Adjustment Configuration>

A hygrothermo sensor 103 which detects a temperature and a humidity inside the main body housing 10 is disposed in an appropriate position (e.g., an upper front-side position) within the main body housing 10. The color printer 1 further comprises a controller 100 configured to control an operation of the image forming unit 30.

Figure 2:
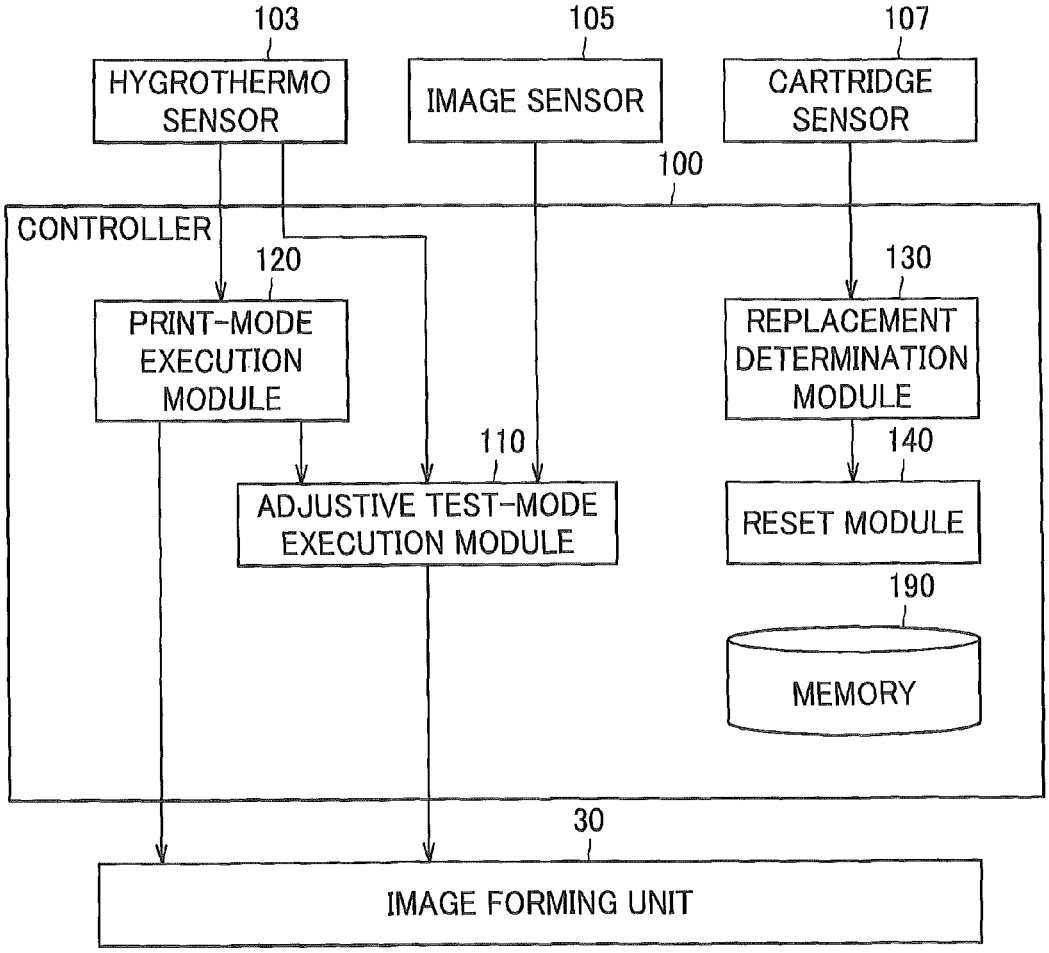
FIG. 2 is a block diagram showing a configuration of a controller.

As shown in FIG. 2, the controller 100 comprises several components relevant to the present invention, which includes an adjustive test-mode execution module 110, a print-mode execution module 120, a replacement determination module 130, a reset module 140 and a memory 190. The controller 100 is configured to control the operation of the image forming unit 30 based upon signals outputted from the hygrothermo sensor 103, the image sensor 105 and the cartridge sensor 107. The controller 100 includes a central processing unit or CPU, a read only memory or ROM, a random access memory or RAM, and other hardware components, and the CPU implements each of functional modules as described above by loading and executing a relevant program.

The adjustive test-mode execution module 110 is configured to execute an adjustive test-mode process in which the image forming unit 30 is controlled to perform a test print including, for example, putting a predetermined test pattern of toner on the conveyor belt 73, and the test pattern is read out by the image sensor 105 (hereinafter referred to as 'patch test'), to determine a control parameter for use in adjustment of the print density. Determination of the control parameter may be made by any known method. In the present embodiment, the control parameter is a value for use in computing a voltage to be applied to the developing roller 53, so-called developing bias. The adjustive test-mode execution module 110 is further configured to, after determining the control parameter by executing the adjustive test-mode process, cause the memory 190 to store the determined parameter associated with a specific surrounding condition under which the test print in this adjustive test-mode process was performed. In this embodiment, the specific surrounding condition includes temperature and humidity detected by the hygrothermo sensor 103.

Figures 3A, 3B:
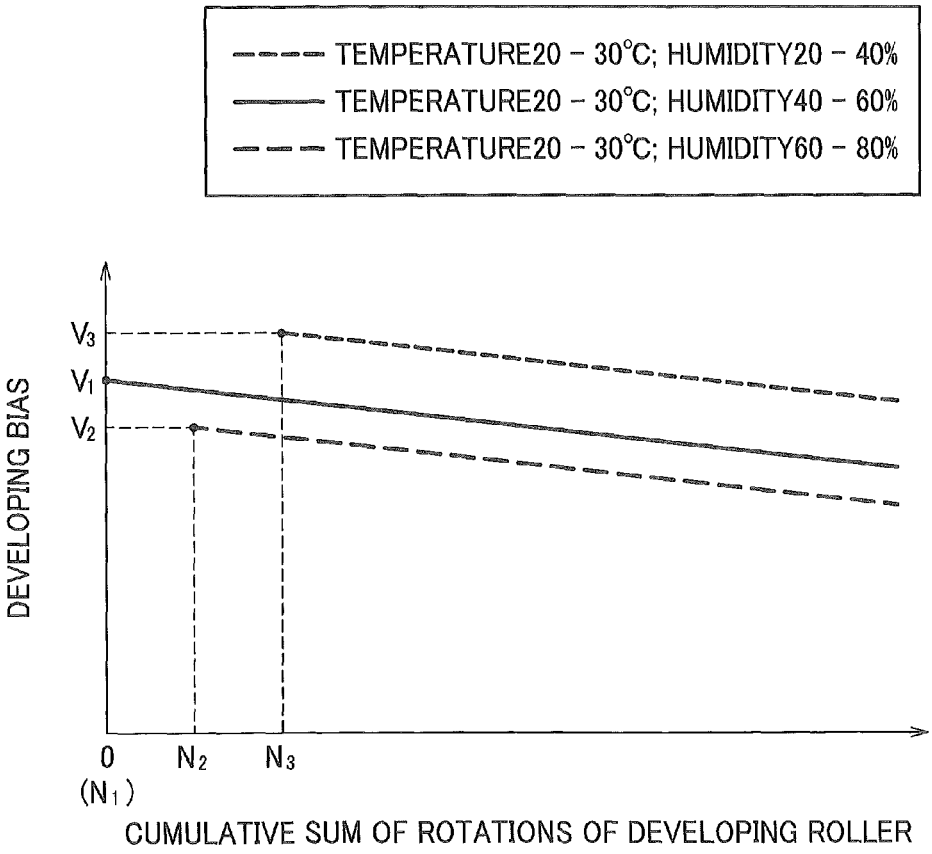
FIG. 3A is a table stored in a memory.
FIG. 3B is a graph showing a relationship between the cumulative sum of rotations of a developing roller and a developing bias.

In the present embodiment, the voltage applied to the developing roller 53 is regulated in accordance with a cumulative sum of rotations of the developing roller 53; thus, values of the developing bias (e.g., $V_1$, $V_2$, $V_3$) and the cumulative sum of rotations of the developing roller 53 (e.g., $N_1$, $N_2$, $N_3$) are paired and associated with one of the conditions defined by temperature and humidity ranges as shown in the table of FIG. 3A, and stored in the memory 190. The table shown in FIG. 3A has all fields blank (null) upon startup of the color printer 1 and just after replacement of the photoconductor cartridge 50A or the development cartridge 50B. As the color printer 1 is operated under various surrounding conditions, the adjustive test-mode process executed by the adjustive test-mode execution module 110 produces control parameters corresponding to the surrounding conditions under which the test print in the adjustive test-mode process was performed, and thus-produced control parameters are recorded in the relevant fields corresponding to the surrounding conditions.

The print-mode execution module 120 is configured to execute a print-mode process of causing the image forming unit 30 to perform image formation. When the print-mode execution module 120 executes the print-mode process, the print-mode execution module 120 searches the memory 190 for a relevant control parameter corresponding to a current surrounding condition. If the relevant control parameter is found in the memory 190, the print-mode execution module 120 retrieves the relevant control parameter, which is then applied to the image formation to be performed by the image forming unit 30. To be more specific, based upon the values of the developing bias and the cumulative sum of rotations of the development roller 53 predetermined as shown in FIG. 3A, and a coefficient pre-stored in the memory 190, a correlation between the cumulative sum of rotations and the developing bias of the developing roller 53 as shown in FIG. 3B is provided. Based upon this correlation, the developing bias corresponding to the current value of the cumulative sum of rotations of the developing roller 53 is determined. The thus-determined developing bias is applied to the developing roller 53 to perform image formation. On the other hand, if the relevant control parameter corresponding to a current surrounding condition is not stored in the memory 190, the print-mode execution module 120 causes the adjustive test-mode execution module 110 to execute an adjustive test-mode process to determine a control parameter, which is then applied to the image formation to be performed by the image forming unit 30.

The replacement determination module 130 is configured to determine, based upon a signal from the cartridge sensor 107, as to whether the photoconductor cartridge 50A and/or the development cartridge 50B have been changed. The determination results of the replacement determination module 130 are outputted to the reset module 140. Hereupon, determination to the effect that the photoconductor cartridge 50A has been changed implies that the photoconductor drum 51 has been changed. Similarly, determination to the effect that the development cartridge 50B has been changed implies that the developing roller 53 has been changed.

The reset module 140 is configured to reset control parameters stored in the memory 190 if at least one of the photoconductor drum 51 and the developing roller 53 has been changed. Determination as to whether the at least one of the photoconductor drum 51 and the developing roller 53 has been changed is made based upon the determination results of the replacement determination module 130. To be more specific, in the present embodiment, the control parameters stored in the memory 190 are reset if the photoconductor cartridge 50A has been changed and/or if the development cartridge 50B has been changed. Accordingly, if at least one of the photoconductor cartridge 50A and the development cartridge 50B has been changed, the reset module 140 clears the table of FIG. 3A, making all the fields of the table shown in FIG. 3A blank.

The memory 190 is a storage device which stores control parameters for use in adjustment to be made in the print density, each control parameter being associated with a specific surrounding condition. In this embodiment, the control parameters stored in the memory 190 include the values of the developing bias $V_n$ and the cumulative sum of rotations $N_n$ of the developing roller 53 as explained with reference to FIG. 3A, and the coefficient corresponding to the slope of the graphs shown in FIG. 3B. The coefficient stored in the memory 190 may be a single value characteristic of the developing roller 53 independent of the surrounding conditions. Alternatively, the coefficient stored in the memory 190 may include values associated with the temperatures and the humidities. As shown in FIG. 3B, in the present embodiment, a proper value of the developing bias is set such that the developing bias decreases according as the cumulative sum of rotations of the developing roller 53 increases.

The memory 190 also stores various data such as the cumulative sum of rotations of the developing roller 53, which may be utilized to implement one or more of the embodiments of the present invention.

<Process in Controller>

One example of the process carried out in the controller 100 as described above will now be described in detail.

Figure 4:
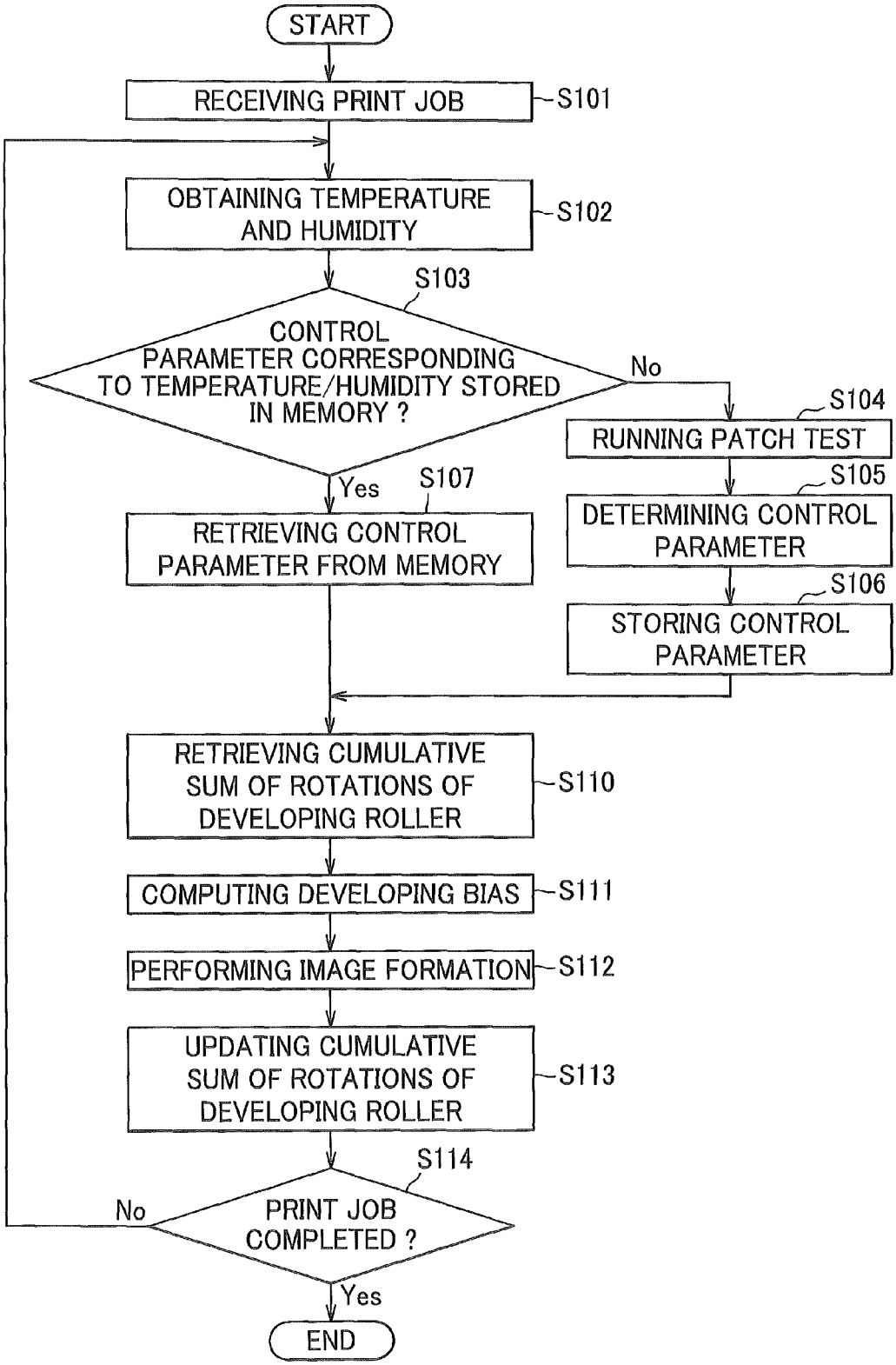
FIG. 4 is a flowchart showing a process to be performed when a print job is received.

As shown in FIG. 4, the controller 100 receives a print job (S101), and obtains a temperature and a humidity from the hygrothermo sensor 103 (S102). The controller 100 then makes a determination in step S103 as to whether or not the control parameter corresponding to the current temperature-and-humidity condition is available (stored) in the memory 190. If the result of determination in step S103 indicates that the relevant control parameter is not stored in the memory 190 (No in step S103), then the controller 100 runs a patch test (S104), determines a developing bias as a control parameter corresponding to the current values of temperature, humidity and cumulative sum of rotations of the developing roller (S105), and stores the control parameter in the memory 190 (S106).

On the other hand, if the result of determination in step S103 indicates that the relevant control parameter corresponding to the current temperature-and-humidity condition is available (stored) in the memory 190 (Yes in step S103), then the controller 100 retrieves the relevant control parameter from the memory 190 (S107).

Once the relevant control parameter is determined or retrieved in this way, the print-mode execution module 120 retrieves the cumulative sum of rotations of the developing roller 53 from the memory 190 (S110). The print-mode execution module 120 also retrieves a coefficient for use in determining a developing bias, and determines the developing bias based upon the cumulative sum of rotations of the developing roller 53, the coefficient and the control parameter (S111). The print-mode execution module 120 then causes the image forming unit 30 to perform image formation with the thus-determined developing bias applied to the developing roller 53 (S112). The print-mode execution module 120 updates the value of the cumulative sum of rotations of the developing roller 53 according to the time that has elapsed during image formation for one sheet S (S113).

Upon completion of these process steps, the controller 100 makes a determination in step S114 as to whether or not the print job has been completed, and if the result of determination indicates that the print job has not been completed (No in step S114), then the process steps from the step S102 are repeated; if the result of determination indicates that the print job has been completed (Yes in step S114), then the process comes to an end.

Figure 5:
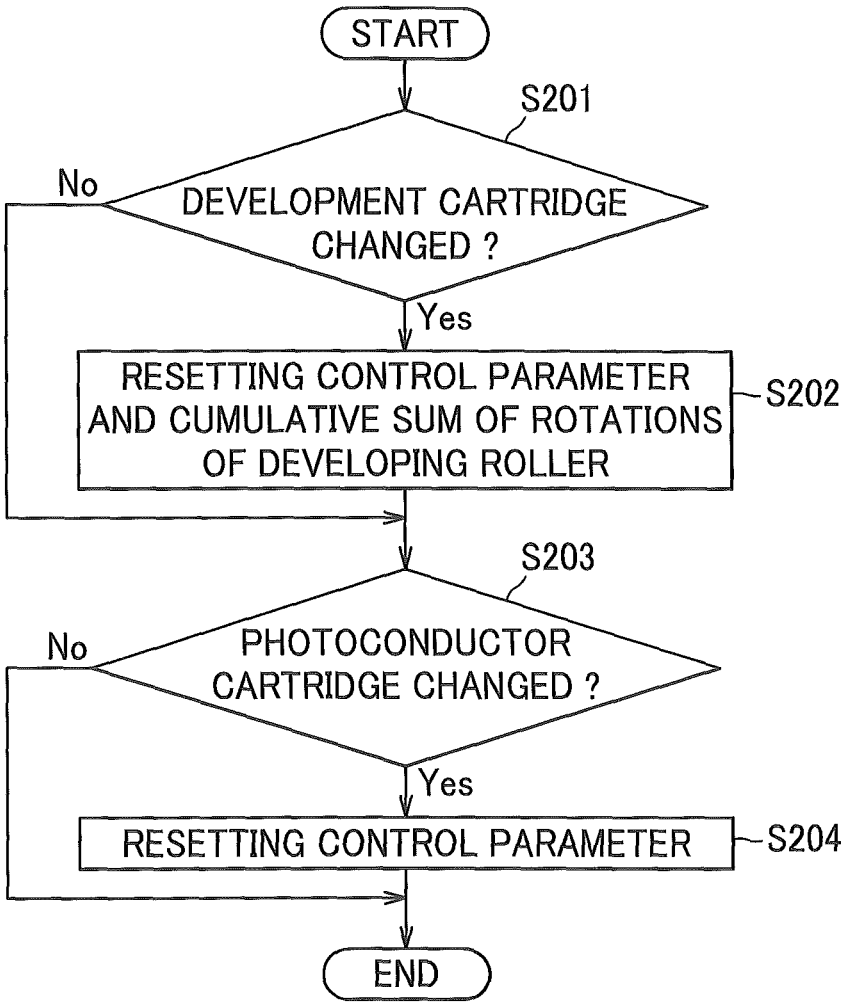
FIG. 5 is a flowchart showing a process associated with replacement of a development cartridge or a photoconductor cartridge.

The replacement determination module 130 of the controller 100 monitors the photoconductor cartridge 50A and the developing cartridge 50B to determine whether the cartridges 50A, 50B have been changed, concurrently with the above-described process of image formation. To be more specific, as shown in FIG. 5, the replacement determination module 130 makes a determination in step S201 based upon a signal received from the cartridge sensor 107 as to whether or not the development cartridge 50B has been changed. If the result of determination in step S201 indicates that the development cartridge 50B has been changed (Yes in step S201), then the reset module 140 resets the control parameters and values of the cumulative sum of rotations of the developing roller 53 stored in the memory 190 (S202). On the other hand, if the result of determination in step S201 indicates that the development cartridge 50B has not been changed (No in step S201), then the process goes to step S203 without resetting the cumulative sum of rotations of the developing roller 53.

Thereafter, the replacement determination module 130 makes a determination in step S203 based upon the signal received from the cartridge sensor 107 as to whether or not the photoconductor cartridge 50A has been changed. If the result of determination in step S203 indicates that the photoconductor cartridge 50A has been changed (Yes in step S203), then the reset module 140 resets the control parameters (S204). On the other hand, if the result of determination in step S203 indicates that the photoconductor cartridge 50B has not been changed (No in step S203), then the process comes to an end without resetting the control parameter.

<Operation and Advantages>

The color printer 1 configured as described above has a table as shown in FIG. 3A all the fields of which are blank when a brand-new printer 1 is first used, or when the printer 1 is used first after the photoconductor cartridge 50A or the development cartridge 50B is changed. Therefore, when a print job is received and a printing process is initiated for the first time, the adjustive test-mode execution module 110 performs a patch test, the image sensor 105 reads out a test pattern, and the developing bias is determined as a control parameter. The value of the developing bias and the cumulative sum of rotations of the developing roller 53 are stored in the memory 190 (formulated in the table as shown in FIG. 3A).

Thereafter, if the control parameter corresponding to the current readings of the temperature and the humidity is stored in the table of FIG. 3A when another print job is received, the developing bias is determined using a value of the control parameter so that image formation is performed by applying that value of the control parameter retrieved therefrom; if the corresponding control parameter is not stored in the table, the adjustive test-mode execution module 110 preforms a patch test, the image sensor 105 reads out a test pattern, and the developing bias is determined as a control parameter. This value of the developing bias is also stored in the memory 190, and the fields of the table as shown in FIG. 3A are filled with data one by one and the number of non-blank fields increases gradually according as the color printer 1 is being used.

With the color printer 1 according to the present embodiment, if a control parameter determined by performing a patch test under the same surrounding condition is stored in the memory 190, the image formation can be initiated immediately by using the control parameter retrieved from the memory 190 without performing another patch test, and thus the printing can be started swiftly. Moreover, the frequency of the patch test can be reduced.

It is appreciated that the print density is likely to change when the photoconductor drum 51 or the developing roller 53 has been changed; with the color printer according to the present invention, if at least one of the photoconductor drum 51 and the developing roller 53 has been changed, the control parameter stored in the memory 190 is reset, so that an improved printing operation appropriate to the surrounding condition can be performed.

Since the color printer 1 is configured to change the developing bias according to the cumulative sum of rotations of the developing roller 53, an improved printing operation with more appropriate density can be performed.

<Modified Embodiments>

Although one illustrative embodiment of the present invention has been described above, the present invention is not limited to the above-described embodiment; the present invention can be practiced in any modified form where appropriate.

For example, although the control parameter stored in the above-described embodiment is a value for use in computing the developing bias so that a change is made to the charging bias in accordance with the cumulative sum of rotations of the developing roller 53, a constant developing bias corresponding to the relevant surrounding condition may be applied irrespective of the cumulative sum of rotations of the developing roller 53. In other words, the control parameter stored in the memory 190 may include the value of the developing bias to be applied to the developing roller 53.

In the above-described embodiment, the medium to which a developer image is to be transferred from the photoconductor drum 51 is exemplified by a sheet S (of paper or the like). In an alternative configuration of the image forming apparatus, consistent with the present invention, of the intermediate transfer scheme where a developer image is to be transferred from the photoconductor drum to a belt, and then from the belt to a sheet, such an intermediate transfer belt to which a developer image is to be transferred from the photoconductor drum may be regarded as the medium.

Figures 6A, 6B:
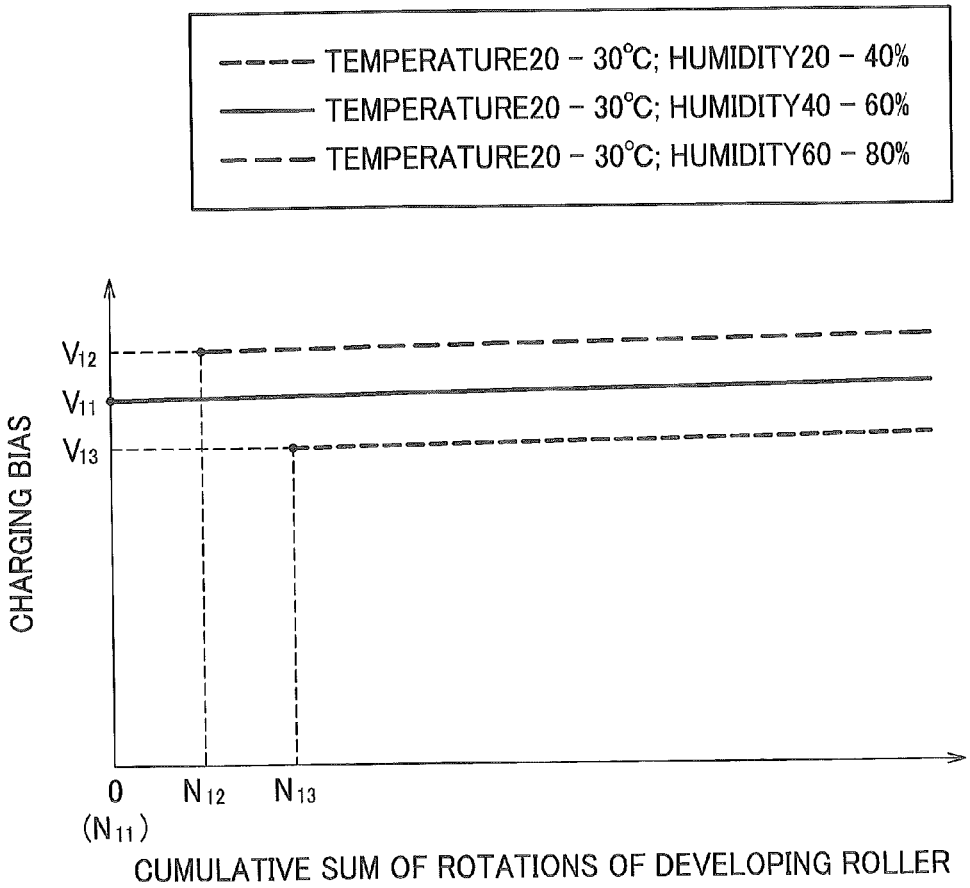
FIG. 6A is a table stored in the memory where charging bias values are stored as control parameters.
FIG. 6B is a graph showing a relationship between the cumulative sum of rotations of the developing roller and charging bias, where the charging bias values are stored as control parameters.

In the above-described embodiment, the control parameter is exemplified by a value for use in computing the developing bias, but the control parameter may include a value for use in computing the voltage to be applied to the charger 52 (so-called charging bias), as shown in FIG. 6A. In this alternative configuration, as shown in FIG. 6A, values of the charging bias $V_{11}$, $V_{12}$, . . . , and the cumulative sum $N_{11}$, $N_{12}$, . . . of rotations of the developing roller 53 are associated with the surrounding condition and stored in the table in the memory 190. In this embodiment, the charging bias is changed in accordance with the cumulative sum of rotations of the developing roller 53; therefore, the values of charging bias corresponding to the surrounding condition are set such that the charging bias for the relevant surrounding condition exhibits values increasing gradually according as the cumulative sum of rotations of the developing roller 53 increases, as shown in FIG. 6B.

In this embodiment (where the charging bias is used as a control parameter) as well, every time when a patch test is performed to determine a charging bias, the charging bias associated with the surrounding condition is stored in the memory 190; therefore, the frequency of the patch test execution can be reduced, and the printing operation can be started swiftly. Moreover, in this embodiment, a value of voltage to be applied to the charger 52 is changed in accordance with the cumulative sum of rotations of the developing roller 53, so that a proper printing operation can be performed.

In this embodiment, a constant charging bias corresponding to the relevant surrounding condition may be applied irrespective of the cumulative sum of rotations of the developing roller 53. In other words, the control parameter stored in the memory 190 may include the value of the charging bias to be applied to the charger 52.

Figures 7A, 7B:
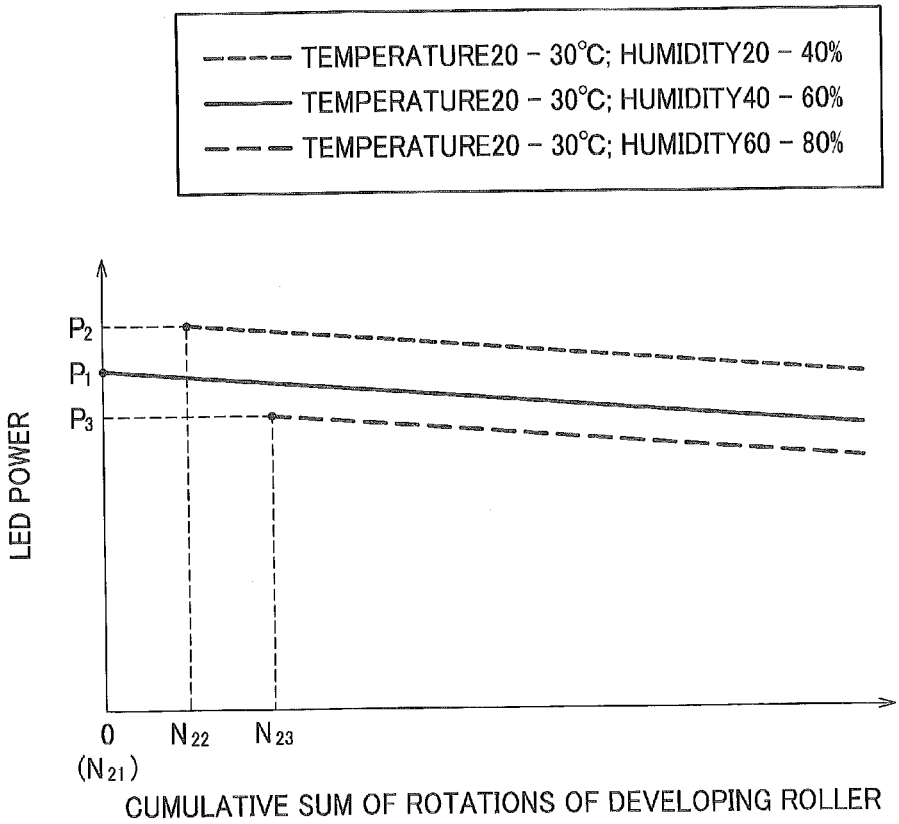
FIG. 7A is a table stored in the memory where scanner power values are stored as control parameters.
FIG. 7B is a graph showing a relationship between the cumulative sum of rotations of the developing roller and LED power, where the scanner power values are stored as control parameters.

The control parameter may include a value for use in computing an output (LED power) of an LED unit 40 as an exposure device. In this alternative configuration, as shown in FIG. 7A, values of the LED power $P_1$, $P_2$, . . . , and the cumulative sum $N_{21}$, $N_{22}$, . . . of rotations of the developing roller 53 are associated with the surrounding condition and stored in the table in the memory 190. In this embodiment, the LED power is changed in accordance with the cumulative sum of rotations of the developing roller 53; therefore, the values of LED power corresponding to the surrounding condition are set such that the LED power for the relevant surrounding condition exhibits values decreasing gradually according as the cumulative sum of rotations of the developing roller 53 increases, as shown in FIG. 7B.

In this embodiment (where the LED power is used as a control parameter) as well, every time when a patch test is performed to determine an LED power, the LED power associated with the surrounding condition is stored in the memory 190; therefore, the frequency of the patch test execution can be reduced, and the printing operation can be started swiftly. Moreover, in this embodiment, an output of the LED unit 40 is changed in accordance with the cumulative sum of rotations of the developing roller 53, so that a proper printing operation can be performed.

In this embodiment, a constant LED power corresponding to the relevant surrounding condition may be applied irrespective of the cumulative sum of rotations of the developing roller 53. In other words, the control parameter stored in the memory 190 may include the value of the LED power to be applied to the LED unit 40.

Figures 8A, 8B:
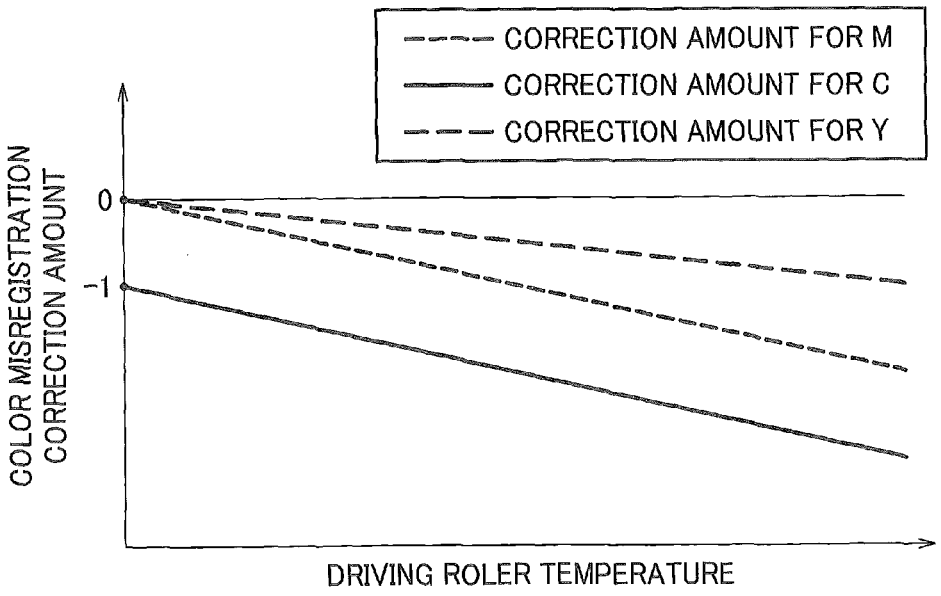
FIG. 8A is a table stored in the memory where the amount of correction of color misregistration for determining timing of exposures for each color are stored as control parameters.
FIG. 8B is a graph showing a relationship between the temperature of the driving roller and the amount of correction of color misregistration at humidities in the 40%-to-60% range, where the amount of correction of color misregistration for determining timing of exposures for each color are stored as control parameters.

The control parameter may include a value for use in adjustment of timing of light exposures for the photoconductor drum 51 to be made to correct color misregistration (this value will hereinafter be referred to as "color misregistration correction amount"). In this alternative configuration, as shown in FIG. 8A, amounts of correction to be made to timing of light exposures for yellow (Y), magenta (M) and cyan (C) relative to that for black are associated with the surrounding condition and stored in the table in the memory 190. In this embodiment, the timing of light exposures is changed in accordance with the temperature of the driving roller 71; therefore, the values of the color misregistration correction amount are set such that the color misregistration correction amount for the relevant surrounding condition exhibits values decreasing gradually according as the temperature of the driving roller 71 increases, as shown in FIG. 8B.

In this embodiment (where the color misregistration correction amount is used as a control parameter) as well, every time when a patch test is performed to determine the color misregistration correction amount, the color misregistration correction amount associated with the surrounding condition is stored in the memory 190; therefore, the frequency of the patch test execution can be reduced, and the printing operation can be started swiftly. Moreover, in this embodiment, a value of color misregistration correction amount associated with the surrounding condition is changed in accordance with the temperature of the driving roller 71, so that the color misregistration correction for color printing can be performed with improved accuracy.

In this embodiment, the color misregistration correction amount may be a constant value corresponding to the relevant surrounding condition which may be applied irrespective of the temperature of the driving roller 71.

Figure 9:
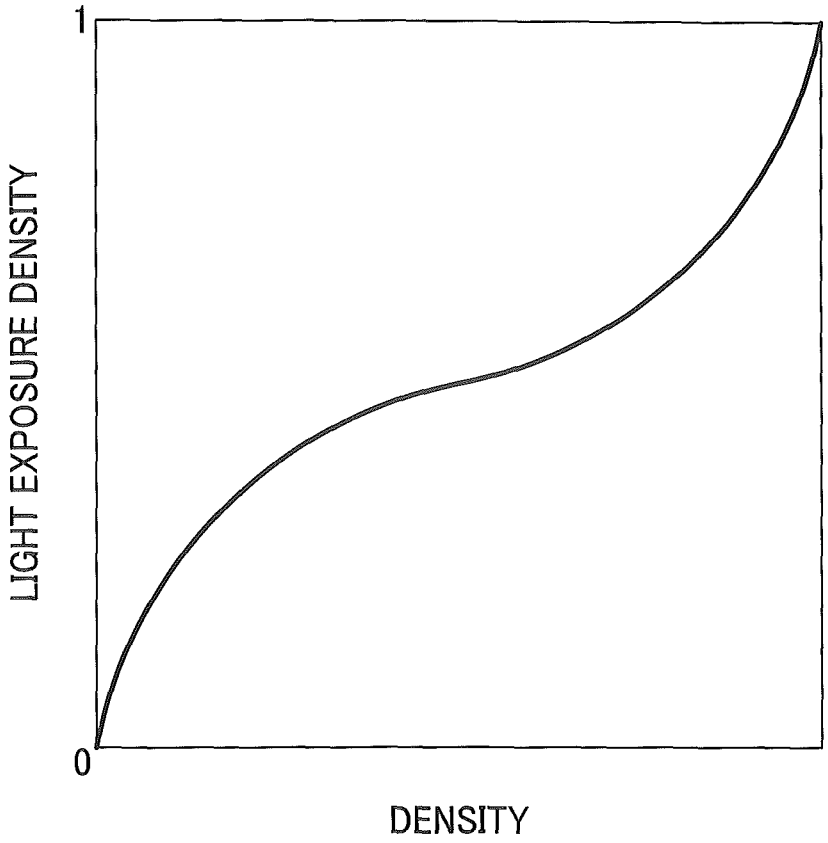
FIG. 9 is a graph showing a relationship between density (image resolution) and light exposure density, where gamma correction values are stored as control parameters.

The control parameter may include a value of gamma correction for adjustment of halftone density or a value for use in computing the value of such gamma correction. In this alternative configuration, as shown in FIG. 9, the relationship between the density indicated in the print job and the light exposure density (pixel density or resolution with which light is to be illuminated for that print job as formulated in a table or a map is stored in the memory 190. The map or table as shown in FIG. 9 is stored for each surrounding condition (temperature and humidity combination), and thus another map or table is stored for another surrounding condition.

The print-mode execution module 120 may be configured to change the value of gamma correction in accordance with the cumulative sum of rotations of the developing roller 53 (illustration of a table or a map for use in this process is omitted). In this configuration, the value of gamma correction may be determined by computation made based upon a value for use in computing the value of gamma correction, or may be retrieved from a pre-stored table in which values of gamma correction are associated with the cumulative sum of rotations of the developing roller 53 and formulated in a table. Since the value of gamma correction is changed, as described above, based on the relevant control parameter, in accordance with a cumulative sum of rotations of the developing roller, a proper printing operation can be performed.

In the above-described embodiment, for easy understanding of the invention, the print-mode execution module 120 has only one print mode. There may be a plurality of print modes, and control parameters may be stored independently for each print mode in the memory 190.

For example, the print-mode process executed by the print-mode execution module 120 may include a normal mode process and a high-definition mode process in which the image forming is performed with finer definition than that with which the image forming is performed in the normal mode process. In this configuration, the adjustive test-mode execution module 110 determines the control parameters for the normal-mode process and for the high-definition mode process, respectively, which are stored independently in the memory. In other words, tables formulated as described above and shown in FIG. 3A may be stored for each print mode. With this configuration in which control parameters are stored independently for normal mode and for high-definition mode, an appropriate printing operation more conformable with the surrounding conditions can be performed.

In the above-described embodiment, the cumulative sum of rotations of the developing roller 53 is counted actually, the control parameter is changed in accordance with the actual count of the cumulative sum of rotations of the developing roller 53; however, a value correlating with the cumulative sum of rotations of the developing roller 53 may be used as the cumulative sum of rotations of the developing roller 53. Examples of such a correlated value may include the number of printed sheets, the cumulative sum of rotations of the photoconductor drum 51, and operation time of the developing roller 53.

Although the above-described embodiments including the modified embodiments, respectively, illustrate one kind of control parameters, more one than kind of parameters may be associated with the surrounding condition and stored in the memory 190.

In the above-described embodiments, the surrounding condition is exemplified by the temperature and the humidity of the environment in which the image forming apparatus is used; alternatively, an absolute humidity (moisture content), or resistance of the sheets may be used as a surrounding condition.

In the above-described embodiment, the reset module 140 is configured to reset the control parameters if at least one of the photoconductor cartridge 50A and the development cartridge 50B has been changed; in an alternative configuration where a developer container is configured as an independently replaceable cartridge and provided separately from the photoconductor drum 51 and the developing roller 53, the reset module may be additionally or alternatively configured to reset the control parameters if such a container configured to store developer has been changed.

In the above-described embodiments, the color printer 1 which can perform multi-color printing is illustrated as an example of an image forming apparatus, but the image forming apparatus consistent with the present invention may be a printer which only can perform monochrome printing. The image forming apparatus consistent with the present invention is not limited to a printer; for example, a photocopier or a multifunction peripheral having a flatbed scanner or any other type of document reader may be implemented in accordance with the present invention.

What is claimed is:

1. An image forming apparatus comprising:

an image forming unit including a photoconductor drum, a charger configured to charge the photoconductor drum, an exposure device configured to expose the photoconductor drum to light, and a developing roller configured to supply developer to the photoconductor drum; and a controller configured to control an operation of the image forming unit, wherein the controller comprises:

a memory configured to store control parameters for use in adjustment to be made in at least one of a print density and a color alignment in accordance with a surrounding condition;

a print-mode execution module configured to execute a print-mode process of causing the image forming unit to perform image formation; and an adjustive test-mode execution module configured to execute an adjustive test-mode process of causing the image forming unit to perform a test print, thereby determining a control parameter, and causing the memory to store the determined control parameter associated with a specific surrounding condition under which said test print was performed, wherein the print-mode execution module is configured: (1) to retrieve a relevant control parameter corresponding to a current surrounding condition from the memory if the relevant control parameter is stored in the memory when the print-mode execution module executes a print-mode process; and (2) to cause the adjustive test-mode execution module to execute the adjustive test-mode process, thereby determining a relevant control parameter if the relevant control parameter is not stored in the memory when the print-mode execution module executes the print-mode process, whereby the retrieved or determined relevant control parameter is applied to the image formation to be performed by the image forming unit.

2. The image forming apparatus according to claim 1, wherein the controller further comprises a reset module configured to reset the control parameters stored in the memory if at least one of the photoconductor drum, the developing roller and a container configured to store the developer has been changed.

3. The image forming apparatus according to claim 1, wherein each of the control parameters includes a value of voltage to be applied to the developing roller or a value for use in computing the voltage to be applied to the developing roller.

4. The image forming apparatus according to claim 3, wherein the print-mode execution module is configured to make a change in the voltage to be applied to the developing roller, based on the relevant control parameter, the change being effected in accordance with a cumulative sum of rotations of the developing roller.

5. The image forming apparatus according to claim 1, wherein each of the control parameters includes a value of voltage to be applied to the charger or a value for use in computing the voltage to be applied to the charger.

6. The image forming apparatus according to claim 5, wherein the print-mode execution module is configured to make a change in the voltage to be applied to the charger, based on the relevant control parameter, the change being effected in accordance with a cumulative sum of rotations of the developing roller.

7. The image forming apparatus according to claim 1, wherein each of the control parameters includes a value of output of the exposure device or a value for use in computing the output of the exposure device.

8. The image forming apparatus according to claim 7, wherein the print-mode execution module is configured to make a change in the output of the exposure device, based on the relevant control parameter, the change being effected in accordance with a cumulative sum of rotations of the developing roller.

9. The image forming apparatus according to claim 1, wherein each of the control parameters includes a value of gamma correction for adjustment of halftone density or a value for use in computing the value of gamma correction.

10. The image forming apparatus according to claim 9, wherein the print-mode execution module is configured to make a change in the value of gamma correction, based on the relevant control parameter, the change being effected in accordance with a cumulative sum of rotations of the developing roller.

11. The image forming apparatus according to claim 1, wherein each of the control parameters includes a value for use in adjustment of timing of exposures for the photoconductor drum.

12. The image forming apparatus according to claim 11, wherein the image forming unit further includes a driving roller configured to convey a medium to which a developer image is to be transferred from the photoconductor drum, and wherein the print-mode execution module is configured to make a change in the timing of exposures by the exposure device, based on the relevant control parameter, the change being effected in accordance with a temperature of the driving roller.

13. The image forming apparatus according to claim 1, wherein the print-mode process executed by the print-mode execution module includes a normal mode process and a high-definition mode process in which the image forming is performed by the image forming unit with finer definition than that with which the image forming is performed in the normal mode process, and wherein the adjustive test-mode execution module is configured to determine control parameters for the normal mode process and for the high-definition mode process, respectively, which are stored independently in the memory.

* * * * *